US006361191B1

(12) United States Patent
Simon

(10) Patent No.: US 6,361,191 B1
(45) Date of Patent: Mar. 26, 2002

(54) OFF-AXIS AND SEGMENT COLLIMATION AND PROJECTION

(76) Inventor: Jerome H. Simon, 70 Sumner St., Newton Centre, MA (US) 02159

( * ) Notice: Subject to any disclaimer, the term of this patent is extended or adjusted under 35 U.S.C. 154(b) by 0 days.

(21) Appl. No.: 09/408,973

(22) Filed: Sep. 29, 1999

Related U.S. Application Data

(60) Provisional application No. 60/102,138, filed on Sep. 29, 1998.

(51) Int. Cl.[7] ..... F21V 5/00

(52) U.S. Cl. ..... 362/328; 362/329; 362/335

(58) Field of Search ..... 362/328, 332, 362/335, 336, 329

(56) References Cited

U.S. PATENT DOCUMENTS

| | | | | | |
|---|---|---|---|---|---|
| 1,699,100 | A | * | 1/1929 | Dorey | 362/332 |
| 2,059,033 | A | * | 10/1936 | Rivier | 362/328 |
| 2,359,151 | A | * | 9/1944 | Pennow | 362/267 |
| 3,448,260 | A | * | 6/1969 | Wince et al. | 362/328 |
| 3,739,169 | A | * | 6/1973 | Weinreich | 362/542 |
| 4,159,511 | A | * | 6/1979 | Dejonc | 362/336 |
| 4,264,948 | A | * | 4/1981 | Cherouge | 362/335 |
| 4,373,178 | A | * | 2/1983 | Gulliksen | 362/335 |
| 4,858,091 | A | * | 8/1989 | Fouke | 362/332 |

* cited by examiner

*Primary Examiner*—Sandra O'Shea
*Assistant Examiner*—Peggy A. Neils
(74) *Attorney, Agent, or Firm*—Jerry Cohen; Harvey Kaye; Perkins, Smith & Cohen

(57) ABSTRACT

A light assembly including a central axis along which a light source is intended to be located. A ring lens at least partially surrounds the central axis, the lens having a central projection along a projection axis for projecting the light passing through the lens along the projection axis. The central projection and projection axis are at an angle with respect to the central axis and the angle is not a right angle. The ring lens has a conical entry face which is at an angle with said central axis.

Another embodiment of the light assembly includes a central axis on which a light source is located and a ring lens at least partially surrounding the central axis. The lens is constructed and arranged to provide collimated light horizontally about a plane which is at a right angle to the central axis, and non-collimated light vertically and in directions which are perpendicular to tangents at the exit points of the rays from the lens.

28 Claims, 7 Drawing Sheets

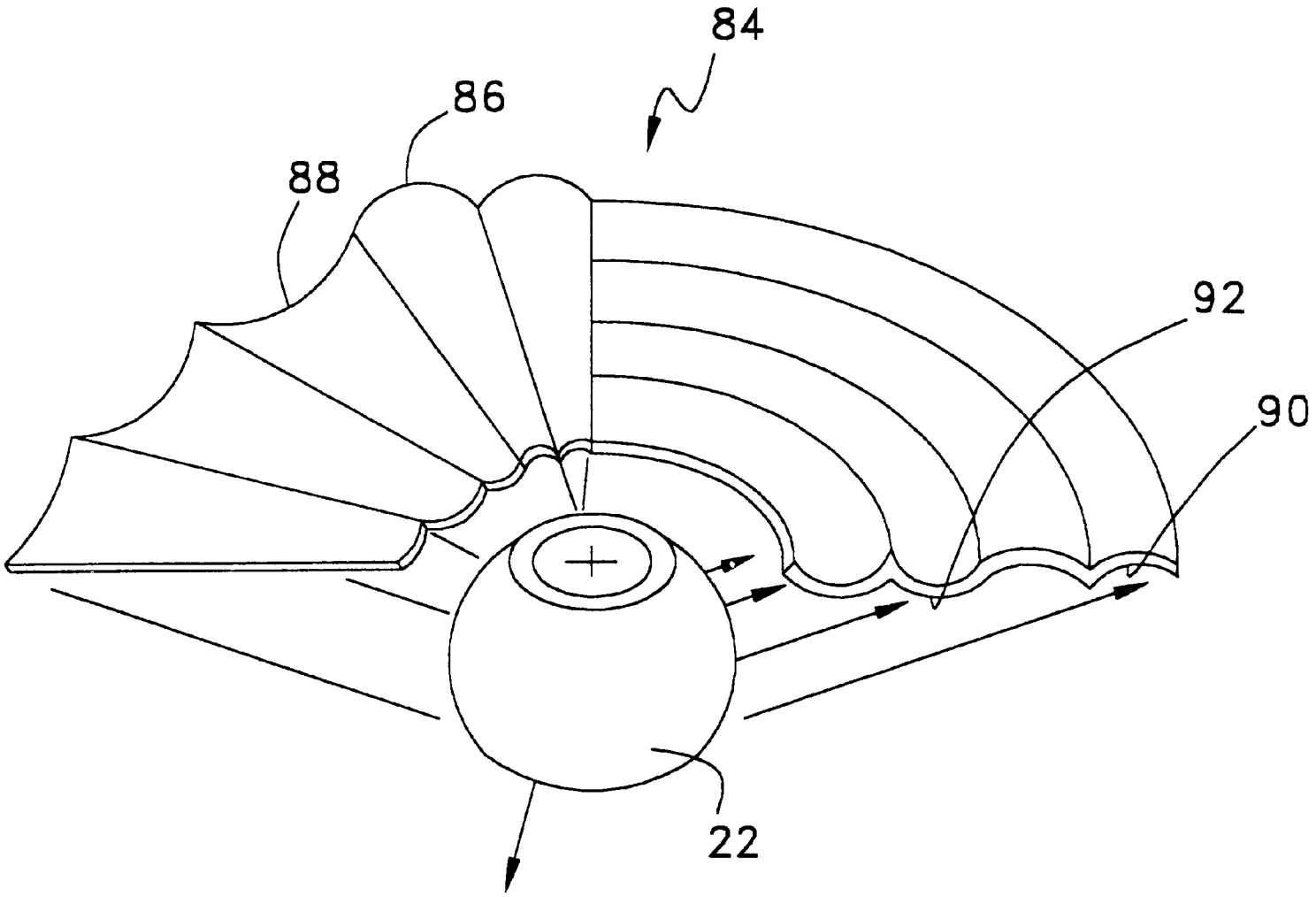
Figure 1–H

OFF-AXIS AND SEGMENT COLLIMATION AND PROJECTION

CROSS-REFERENCE TO RELATED APPLICATIONS

This application is based upon and claims the priority of Provisional Application Serial No. 60/102,138 filed Sep. 29, 1998.

FIELD OF THE INVENTION

The present invention relates generally to the lighting field, and, more particularly, to creating efficient and decorative distribution of illumination using collimation and shaped light projection.

SUMMARY OF THE INVENTION

It is an object of the present invention to broadly distribute and highly direct indoor and outdoor illumination.

It is an object of the present invention to directly project multiple bands of radially collimated light onto multiple surfaces.

It is an object of the present invention to directly project and distribute radially collimated light broadly onto adjacent surfaces.

The present invention provides efficient and decorative distribution of illumination through the use of non-conventional collimation means and shaped light projection. At least in part the benefits of the present invention are provided by greater efficiency by using no reflectors, or fewer reflectors than the prior art.

Different types of collimation means are disclosed, for example, in my application Serial No. 08/201,466, filed Feb. 25, 1994, entitled Architectural Lighting Distributed From Contained Radially Collimated Light, and now U.S. Pat. No. 5,897,201 issued Apr. 27, 1999, and in my Provisional application Serial No. 60/058,195 filed Sep. 8, 1997, entitled Compact Efficient Luminaire For Altering Illumination Distribution In Architectural Space While Maintaining Low, Safe Operating Temperature, and also in my pending PCT application based in part upon Serial No. 08/201,466 and Serial No. 60/058,195 filed Sep. 3, 1998, entitled Architectural Lighting Distributed From Contained Radially Collimated Light and Compact Efficient Luminaries, International Application No. PCT/US98/18419.

BRIEF DESCRIPTION OF THE DRAWINGS

FIG. 1H is a partial isometric view of a lighting arrangement using different shapes of surfaces adjacent the lens.

DETAILED DESCRIPTION OF THE PREFERRED EMBODIMENTS

Figure 1:
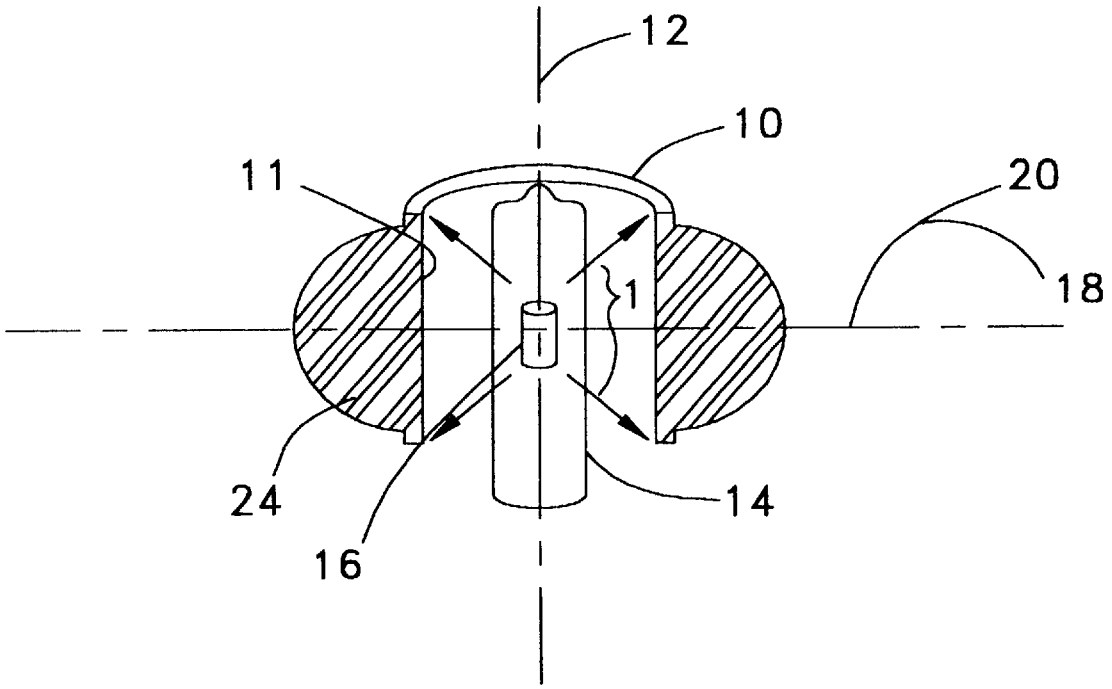
FIG. 1 is a sectional isometric view of a lighting arrangement having a ring lens with a radial axis.

FIG. 1 is a sectional isometric view of radially constructed typical collimating ring lens 10. In typical collimating ring lenses the central axis 12 (which is the central axis of lamp 14, also passing through light center 16) is perpendicular to the central plane of radial light 18 emanating from the light center 16. Also the plane of radial light 18 (within a typical ring lens) coincides with the central projection axis 20 of the ring lens. This construction has a cylindrical entry face 11.

However, in the off-axis ring lens 22 (illustrated in FIG. 1A) the central projection axis 20 is at a predetermined radial angle A1 to the central plane of radial light 18. This is achieved by rotating the continuous aspheric (or spherical) section 24 about the light center 16, with the result that the conical entry face 26 of lens 22 is at angle A2 to central axis 12. Angle A2 is equal to angle Al. Therefore, light rays R from lamp 14 that enter conical entry face 26 are radially collimated by lens 22 and are projected as a continuous radial pattern as and between rays R1, R3 and R2, R4 (R1, R2, R3 and R4 being parallel to central projection axis 20).

Figure 1A:
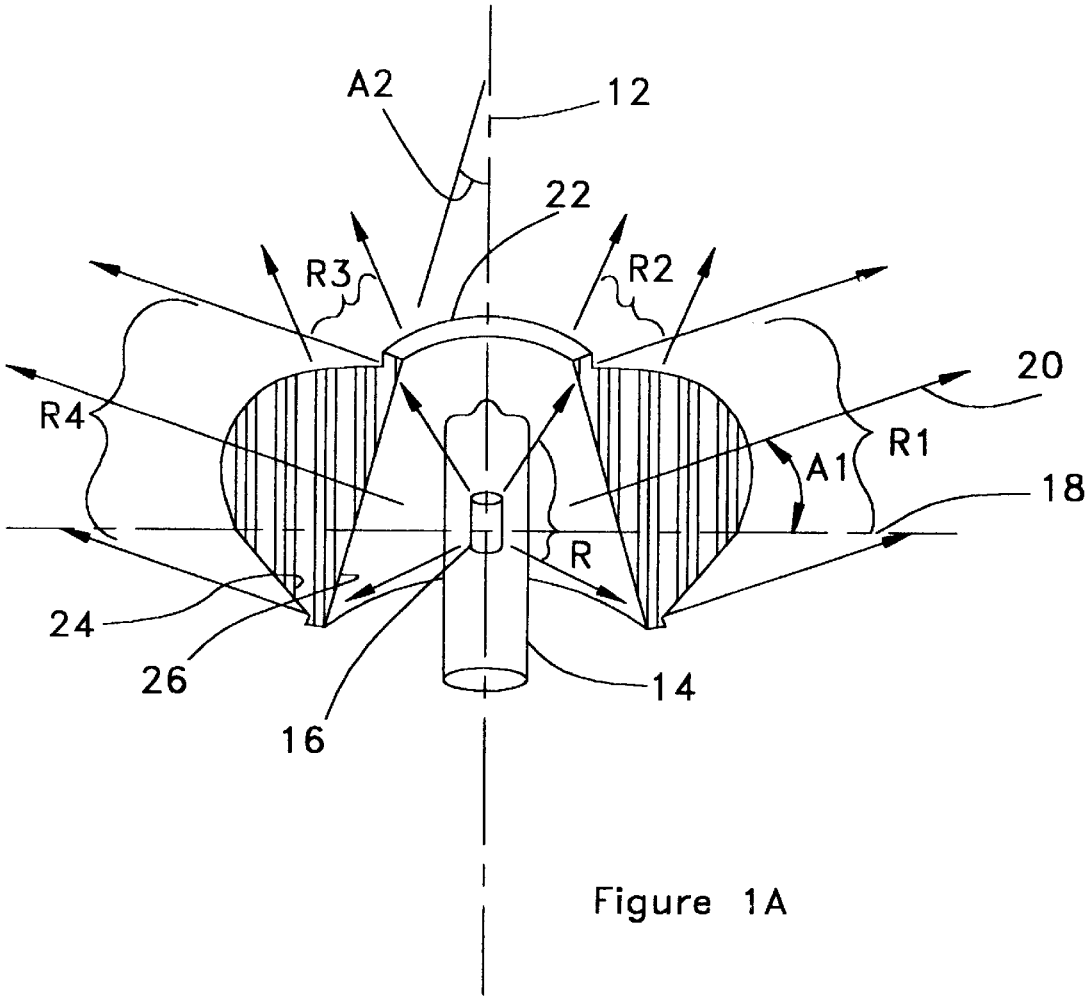
FIG. 1A is a sectional isometric view of a lighting arrangement having a ring lens with an axis which is inclined with respect to the radial axis.
Figure 1B:
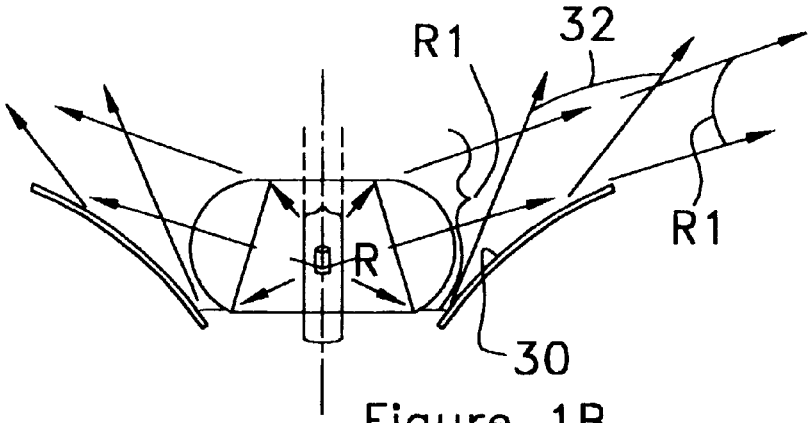
FIG. 1B is a schematic view of the arrangement of FIG. 1A having a radial reflector.

FIG. 1B is a diagram showing a cross section of FIG. 1A with an additional reflector surface 30 which intercepts rays R1 and reflects them as rays 32 in order to broaden or concentrate the distribution of R1. The section of 30 may be flat, convex, concave, hyperbolic, or parabolic. (This may be, for example, as disclosed using a typical lens ring as in my above mentioned U.S. Pat. No. 5,897,201 and in pending application Ser. No. 08/201,466, International Application No. PCT/US98/18419 filed Sept. 3, 1998.)

Figure 1C:
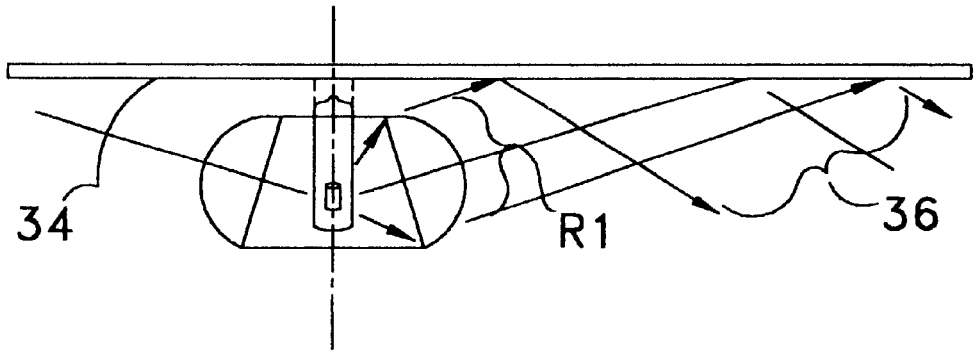
FIG. 1C is a schematic view of the lighting arrangement of FIG. 1A disposed close to an architectural surface.

FIG. 1C is a diagram showing a cross section of FIG. 1A with the addition of reflector plane or surface 34. Rays R1 are projected onto and away from surface 34 as reflected rays 36. Surface 34 may be a painted ceiling causing rays 36 to be scattered; Surface 34 may be flat and specular, changing the direction of rays 36 (as represented by FIG. 1C). Further modifications of R1 rely on other surface conditions of surface 34, including such optical treatments as concentric or radial, convex or concave depressions or lines as shown, for example, in FIG. 1H where the lens 22 is disposed below a surface generally indicated as 84 which is shown having several different surface configurations, but which may be constructed all of the same configuration. For example, FIG. 1H shows radial convex 86 and radially concave 88 forms and also concentric convex 90 and concentric concave 92 forms of surfaces which may be used in any desired arrangement where they are all of the same configuration or any mixture thereof.

Figure 1D:
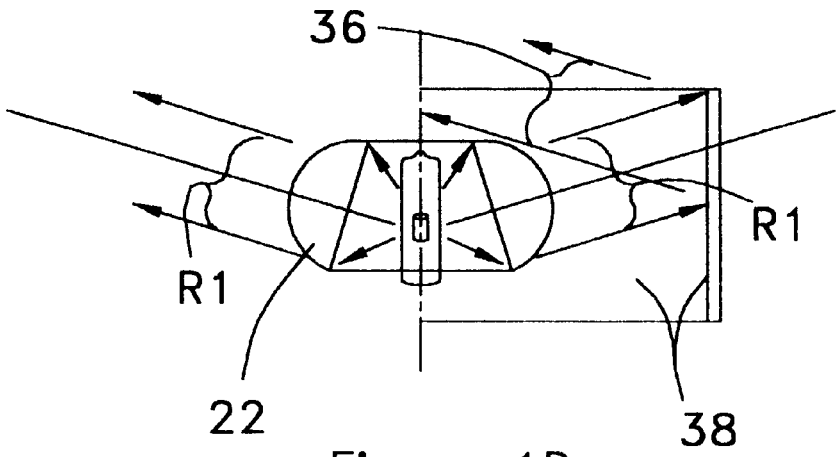
FIG. 1D is a schematic view of the lighting arrangement of FIG. 1A having a vertical reflector.

FIG. 1D is a diagram of a cross section of FIG. 1A with the addition of reflective surface 38 which reflects R1 over the top of ring 22. Surface 38 may be flat, in which case rays R1 will be reflected over the top of ring 22 in a continually radially diverging manner. Surface 38 may be concave, causing rays R1 to be reflected over ring 22 and radially converge over ring 22.

Figure 1E:
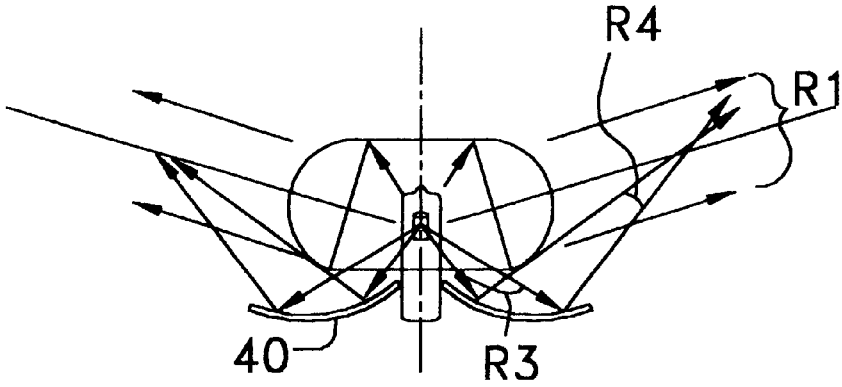
FIG. 1E is a schematic view of the lighting arrangement of FIG. 1A having a lower reflector ring.

FIG. 1E is a diagram of a cross section of FIG. 1A with the addition of lower reflector ring 40 which reflects radiant rays R1 (not gathered by ring 22) through the path of R1 as R4. If lower reflector ring 40 is ellipsoidal (as shown) in section, ray R3 will be reflected as a convergent, then divergent ring of rays. If lower reflector ring 40 is parabolic and radially off-axis (with the central projection axis (of the parabola) parallel to axis 20 FIG. 1A), rays R4 will be parallel to rays R1.

Figure 1F:
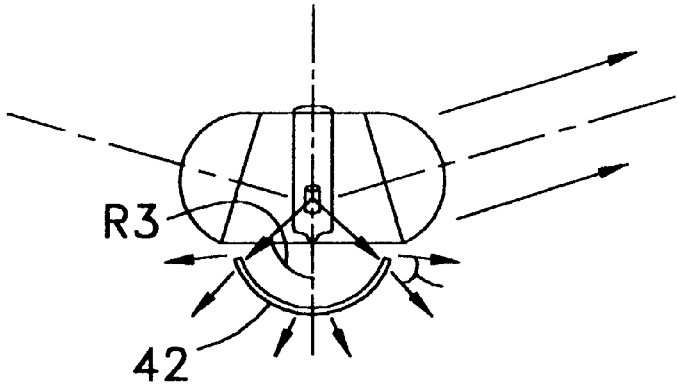
FIG. 1F is a schematic view of the lighting arrangement of FIG. 1A having a single lower curved prismatic diffuser.
Figure 1G:
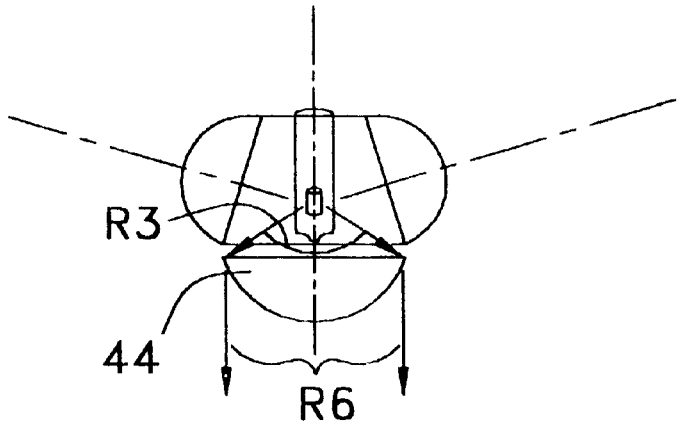
FIG. 1G is a schematic view of the lighting arrangement of FIG. 1A having a lower lens.

FIG. 1F is a diagram of a cross section of FIG. 1A with the addition of plate or bowl shaped prismatic diffuser 42, causing rays R3 to be diffused as rays R5. FIG. 1G is a diagram of FIG. 1A with the addition of lens 44 which gathers and projects rays L3. The lens/reflector configurations of FIGS. 1B, 1C, and 1D may be combined with reflectors and lenses of FIGS. 1E, 1F, and 1G.

Figure 2:
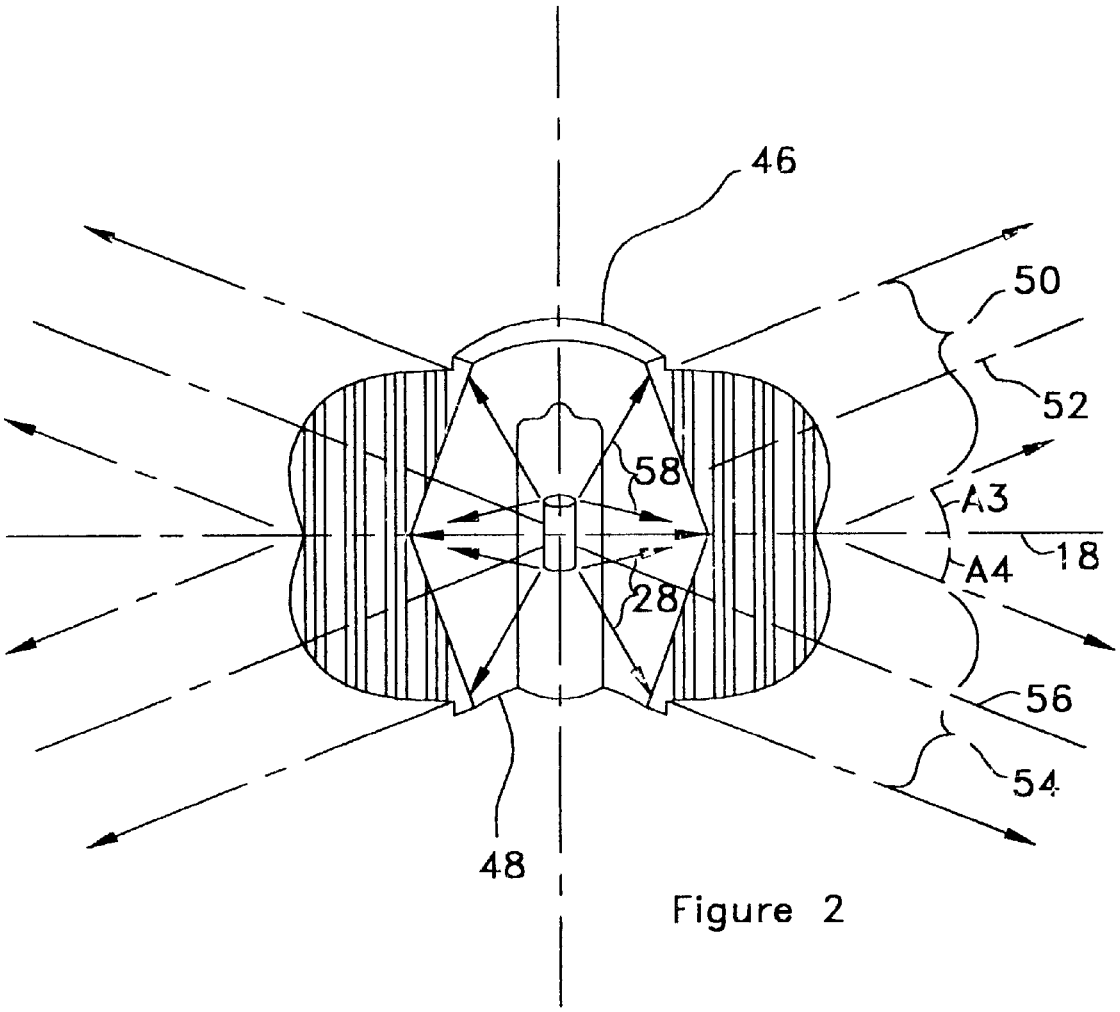
FIG. 2 is a sectional isometric view of a lighting arrangement having a double ring lens.

FIG. 2 is an isometric diagram showing a construction of two off-axis ring lenses 46 and 48, each lens ring having a radial section removed so that they can be joined along the plane of radial light 18. This construction results in two radially projected collimated beams 50 (parallel to central projection axis 52) and 54 (parallel to central projection axis 56). Both collimated beams 50 and 54 are a result of lens 46 collimating rays 58 and lens 48 collimating rays 28, respectively. Collimated beams 50 and 54 are diverging away from radial light plane 18 by predetermined degrees of radial angles A3 and A4, respectively.

Figure 3A:
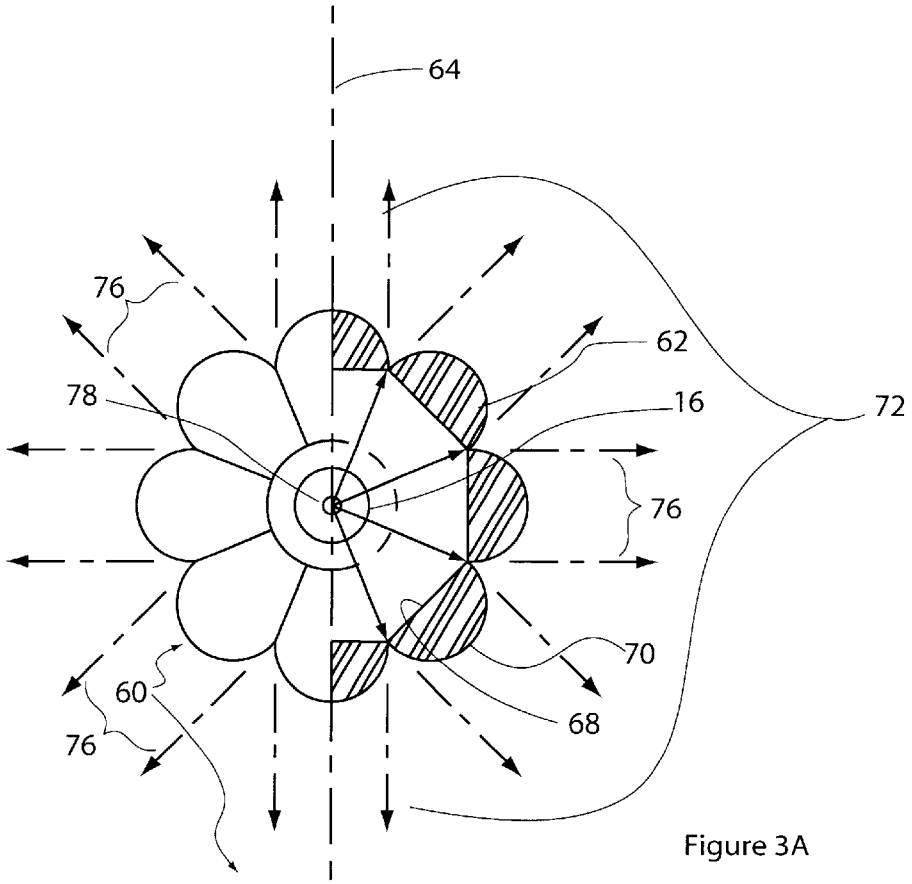
FIG. 3A is a plan view partly in section of another lighting arrangement.
Figure 3B:
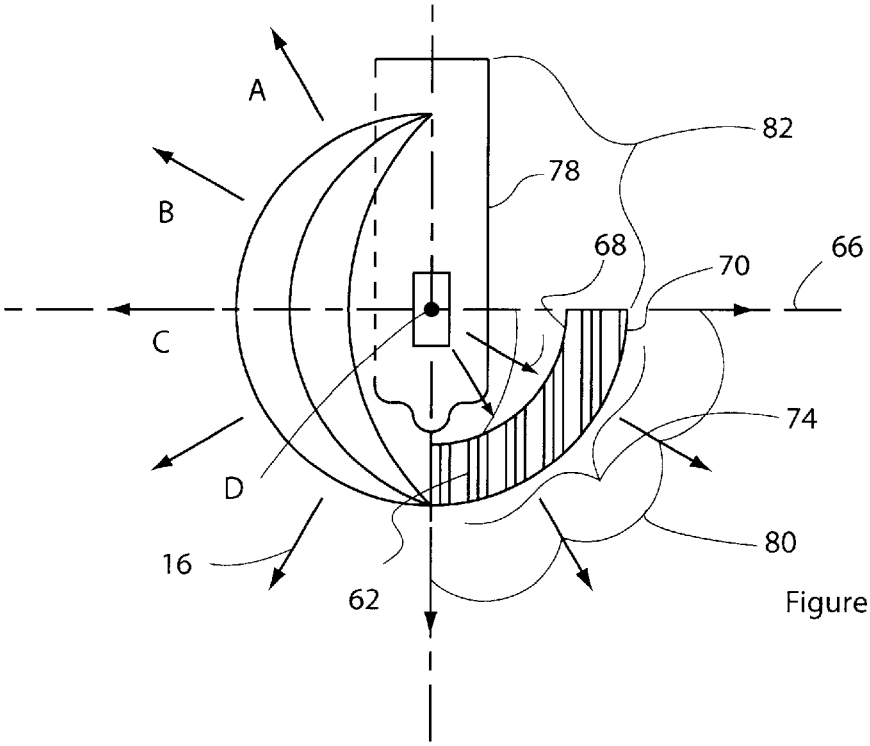
FIG. 3B is a side elevation partly in section of the lighting arrangement of FIG. 3A.

FIG. 3A is a plan view, partly in section, and FIG. 3B is a side elevation, partly in section, which illustrate the spherical construction 60 of cylindrical or aspheric (in section) ring lenses 62. The ring lenses 62 are radially disposed about vertical axis 64 (which, in FIG. 3A is actually coming up out of and perpendicular to the paper) and taper (in section) as they join about vertical axis 64.

Radial cutaway section 72 (through radial axis 66, see FIG. 3B) illustrates typical inner surface 68 and outer surface 70 of ring lenses 62. The inner surface may be flat horizontally (as shown in FIG. 3A) but curved vertically (as shown in FIG. 3B). Also, the inner surface may be a shallow concave or convex surface in the horizontal direction. The outer surface 70 is spherical or aspherical. The inner surface 68 and the outer surface 70 of the ring lenses 62 remain concentric to each other vertically as illustrated in FIG. 3B vertical section 74. This construction results in radially collimated beams 76 projecting continuously about light center 16, in a horizontal plane passing through axis 66. However, in the vertical direction (see FIG. 3B) the rays are perpendicular to tangents at the exit points of the rays as illustrated by directional arrows A, B, C, D, and E and as rays 80.

Vertical section 82 shows a 90 degree vertical section where ring lenses have been removed. This illustrates that sections of the ring lenses may be removed depending on the application of the system.

FIGS. 3A and 3B also show that spherical lens construction 60 is divided into eight sections, each containing a ring lens 62. Other constructions may be of as few as three lenses or as many as 100 or more. Spherical construction may be made with the omission of one or more ring lenses leaving a gap which may or may not be infilled with another optical element such as a window, a diffuser, or a lens segment with a different focal property such as a negative focal length.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. In a light assembly including a light source, the improvement comprising:

a longitudinal axis along which a light source is intended to be located;

a ring lens at least partially surrounding said longitudinal axis for collimating light, said lens having a central projection along a projection axis for projecting the light passing through said lens along said projection axis;

said central projection and projection axis being at an angle with respect to the longitudinal axis which angle is other than a right angle, said ring lens having a conical entry face which is at an angle with said longitudinal axis.

2. A light assembly as defined in claim 1 further comprising a reflector ring, said conical entry face having a wider end, and said reflector ring being disposed at the wider end of the conical entry face and positioned to reflect rays from a light source which do not pass through said ring lens.

3. A light assembly as defined in claim 2 wherein said reflector ring is ellipsoidal.

4. A light assembly as defined in claim 2 wherein said reflector ring is parabolic.

5. A light assembly as defined in claim 4 wherein said longitudinal axis is parallel to the projection axis.

6. A light assembly as defined in claim 1 further comprising a prismatic diffuser, said conical entry face having a wider end, and said prismatic diffuser being disposed at the wider end of the conical entry face and positioned to reflect rays from a light source which do pass through said ring lens.

7. A light assembly as defined in claim 6 wherein said diffuser is a plate.

8. A light assembly as defined in claim 6 wherein said diffuser is bowl shaped.

9. A light assembly as defined in claim 1 further comprising a second ring lens, each ring lens having a radial section removed and being joined along a plane of radial light to provide collimated ray sets which are parallel to the projection axis.

10. A light assembly as defined in claim 1 further comprising a reflector at least partially surrounding said ring lens to broaden or concentrate the distribution of rays from a light source through the ring lens.

11. A light assembly as defined in claim 10 wherein said reflector has a shape which is selected from the group comprising flat, convex, concave, hyperbolic or parabolic.

12. A light assembly as defined in claim 1 further comprising an element providing a reflector plane and disposed outside the radial projection of the ring lens to reflect a portion of the rays passing through said ring lens.

13. A light assembly as defined in claim 1 further comprising a reflector at least partially surrounding said ring.

14. A light assembly as defined in claim 13 wherein said reflector is flat and at least some of the reflected rays pass above or below the ring lens in a continually radially diverging manner.

15. A light assembly as defined in claim 13 wherein said reflector is concave and at least some of the reflected rays pass above or below the ring lens and radially converge.

16. A light assembly as defined in claim 1 further comprising a lens, the conical entry face having a wider end, said lens being disposed at the wider end of the conical entry face for gathering and projecting rays which do not pass through the ring.

17. In a light assembly having a light source, the improvement comprising:

a longitudinal axis on which a light source is intended to be located; and a ring lens of segments for at least partially surrounding a longitudinal axis, said lens being constructed and arranged to provide collimated light horizontally about a plane which is at a right angle to said longitudinal axis, and non-collimated light vertically and in directions which are perpendicular to tangents at the exit points of the rays from the lens.

18. A light assembly as defined in claim 18 wherein the light is not collimated in the vertical direction.

19. A light assembly as defined in claim 18 wherein the ring lens is constructed of a plurality of cylindrical or aspheric ring lens segments, said lens segments being radially disposed about the longitudinal axis and tapering as they join one another about the longitudinal axis, the inner and outer surfaces of said lenses being concentric to each other.

20. A light assembly as defined in claim 19 wherein there are at least three ring lens segments.

21. The improvement of claim 1 wherein a light modifying element at least partially surrounds said ring lens.

22. The improvement of claim 1 wherein said conical face is substantially perpendicular to the projection axis.

23. The improvement of claim 1 wherein said ring lens collimates light in only one direction.

24. The improvement as defined in claim 10 wherein said reflector has a plurality of portions each of which is curved.

25. The improvement as defined in claim 1 further comprising a reflector adjacent said ring lens and positioned to reflect the rays from a light source through the ring lens.

26. The improvement as defined in claim 25 wherein said reflector is flat.

27. The improvement as defined in claim 26 wherein said reflector is parallel to the longitudinal axis.

28. The improvement as defined in claim 26 where said reflector is perpendicular to the longitudinal axis.

* * * * *